United States Patent [19]

Pennock

[11] Patent Number: 5,040,720

[45] Date of Patent: Aug. 20, 1991

[54] RETURN ENVELOPE MAILER

[75] Inventor: Thomas G. Pennock, North Tonawanda, N.Y.

[73] Assignee: Moore Business Forms, Inc., Grand Island, N.Y.

[21] Appl. No.: 569,445

[22] Filed: Aug. 20, 1990

[51] Int. Cl.[5] ..... B65D 27/10

[52] U.S. Cl. ..... 229/69; 229/70; 229/73

[58] Field of Search ..... 229/69, 70, 73; 282/11.5 R, 11.5 A

[56] References Cited

U.S. PATENT DOCUMENTS

| | | | |
|---|---|---|---|
| 2,895,664 | 7/1959 | Cone | 229/73 |
| 3,356,285 | 12/1967 | Greason | 229/70 |
| 3,356,286 | 12/1967 | Greason | 229/70 |
| 3,507,519 | 4/1970 | McNabb | 282/25 |
| 3,817,445 | 6/1974 | Greason | 229/69 X |
| 3,837,565 | 9/1974 | Johnsen | 229/68 |
| 4,055,294 | 10/1977 | Traise | 229/69 |
| 4,081,127 | 3/1978 | Steidinger | 229/69 |
| 4,440,341 | 4/1984 | Pennock | 229/69 |
| 4,598,860 | 7/1986 | Pennock | 229/69 |
| 4,651,920 | 3/1987 | Stenner | 229/70 |
| 4,709,850 | 12/1987 | Wagner | 229/69 X |

*Primary Examiner*—Stephen Marcus
*Assistant Examiner*—Jes F. Pascua
*Attorney, Agent, or Firm*—Nixon & Vanderhye

[57] ABSTRACT

A continuous business form assembly includes webs defining return envelopes within originating envelopes, where the webs of the originating envelopes are joined through openings in the return envelope webs. Flaps on both of the return envelope webs are formed of the material from which the openings are cut so that the flaps and openings are simultaneously created, paper waste is reduced and return envelope size increased.

14 Claims, 2 Drawing Sheets

RETURN ENVELOPE MAILER

BACKGROUND OF THE INVENTION

This invention relates to a continuous business form assembly, and more particularly to a continuous, filled envelope assembly, or, in business forms terminology, a return envelope mailer.

As computer printing has facilitated computer billing and the like, the use of continuous business form assemblies has increased. For computer billing and the like, such assemblies have typically included multiple, overlying webs with marginal feed strips. The webs form series of overlying record sheets, originating envelopes, return envelopes, and message sheets. The return envelopes and message sheets are contained within the originating envelopes. The return envelopes and message sheets are removed from the originating envelopes by their first recipients, who separate the assembly along perforation lines as provided. The webs which form the return envelopes and message sheets include spaced, transversely extending openings between the feed strips, which allow the webs which form the originating envelopes to be joined, in part, through the openings and about the return envelopes and message sheets.

While these assemblies have proven successful, the need to provide the return envelopes with a flap or alternate sealing means has been a problem. The dimensions of the envelopes have been limited by this need. In my prior U.S. Pat. No. 4,440,341, this problem was addressed and solved by providing an alternate continuous business form construction which not only increases the possible size of return envelopes for any given assembly but also simultaneously eliminates the paper waste of the openings cut through the one of the webs from which the flaps of the return envelopes are formed. Thus, in may prior patent, I disclose a continuous business form assembly of the type described, in which the flaps of the return envelopes are formed in one web of the material from which the web openings in that web are cut, rather than being formed of the material of the sheets which remain after the openings are cut. The openings of the one web are cut, and the flaps of the return envelopes are formed simultaneously, by the making of two spaced, short, longitudinal cuts and a single, long, transverse cut between the two longitudinal cuts. These cuts simultaneously define three edges of the openings in the web being cut, and three edges of the flaps. The flaps and openings are then completed by a folding of the flaps back against the web along a transverse fold or perforation line.

SUMMARY OF THE INVENTION

It has now been discovered that other of the internal plies of the business form can be "extended" by retaining web portions which otherwise would have been removed and discarded in the formation of other web openings. This provides one or more additional flap portions which may be folded during the manufacturing process and subsequently unfolded and retained by the recipient of the mailer after it is extracted from the outgoing envelope. This discovery facilitates across the web gluing, reduces the bulk at the top and bottom of the forms, reduces paper waste, and utilizes available space within the form. This arrangement can, in fact, result in the elimination of at least one internal ply of the mailer and/or eliminate the need to design a larger conventional mailer. In either case, the invention provides significant savings to the distributors or senders of such mailers.

Thus, in one exemplary embodiment of the invention, there is provided a continuous business form assembly comprising at least a first web, a second web, a third web and a fourth web, all the webs being continuous in a longitudinal direction, and having a transverse extent perpendicular to the longitudinal direction, the first web also having first longitudinally spaced, transversely extending flaps, the flaps each having cut edges and a folded edge, the flaps being folded and thereby providing first openings in the first web adjacent the flaps, the second web having second longitudinally spaced, transversely extending removable flaps, the flaps each having cut edges and a folded edge defined by a transverse line of perforations, the second flaps being folded and thereby providing second openings in the second webs adjacent the second flaps, the second openings longitudinally and transversely substantially aligned with the first openings of the first web, the second web being joined to the first web to form return envelopes such that the first flaps are return envelope flaps, and the second flaps comprise stubs adapted to be removed by a recipient of the form, and wherein the third web being joined to the fourth web, in part through the openings of the first and second webs, and the third and fourth webs being adapted to form originating envelopes including therein the return envelopes.

In another aspect, the invention provides a return mailer form construction comprising a first pair of sheets defining an originating envelope; and a second pair of webs defining a return envelope, each of the second pair of webs provided with a folded flap portion, one of the folded portions comprising a return envelope flap, the other of the folded flap portions comprising a removable message stub adapted to be retained by a first recipient of the mailer.

Other objects and advantages of the present invention will become apparent from the detailed description which follows.

Figure 1:
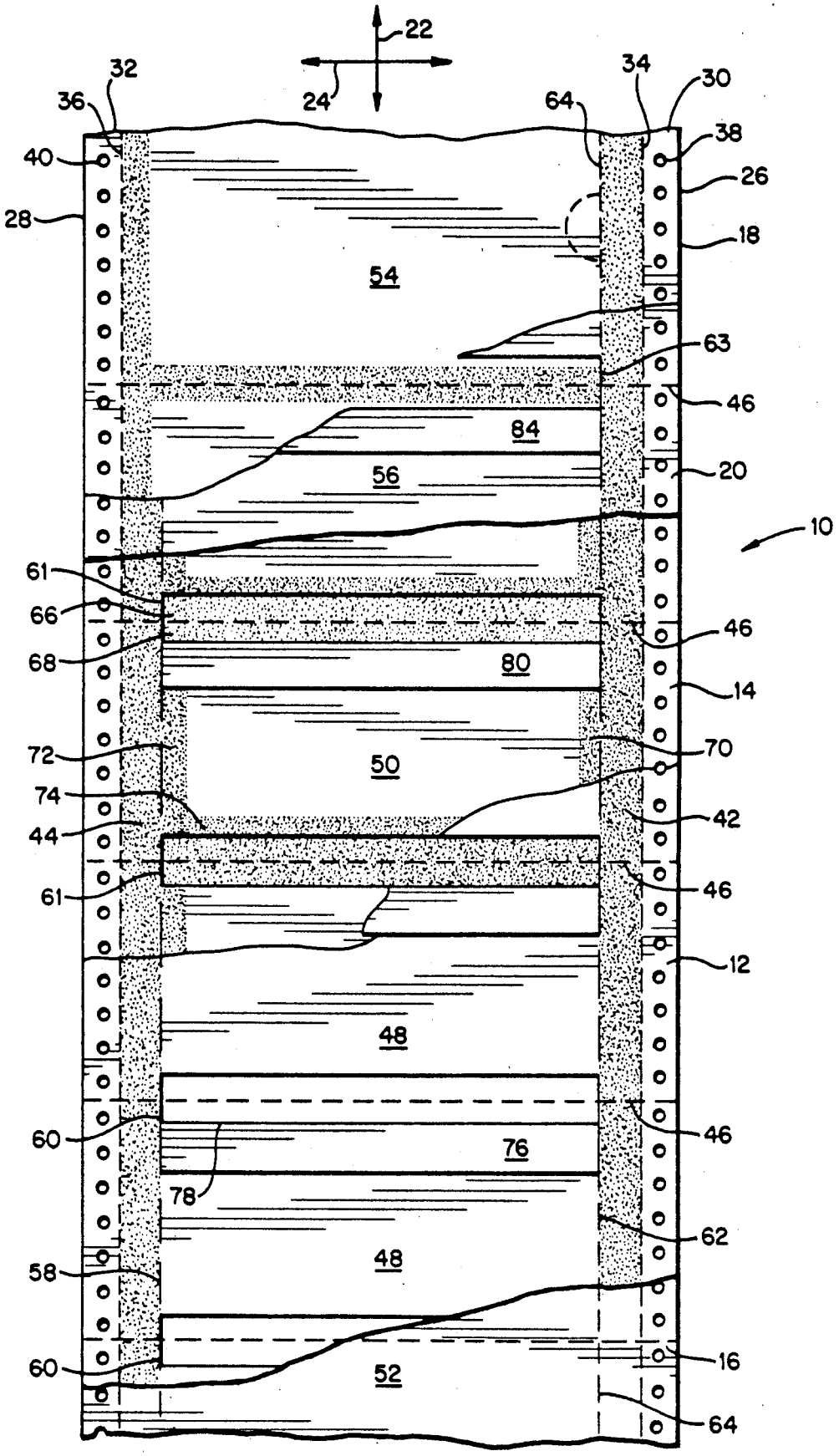
FIG. 1 is a progressively cutaway view of an exemplary embodiment of the invention.

Also in the drawing Figures, and in the description which follows, construction details of the preferred embodiment which are repeated in series and repeated among the webs in overlying relationships, are given a single reference number, despite the repetition, for clarity.

DETAILED DESCRIPTION OF THE DRAWINGS

Figure 2:
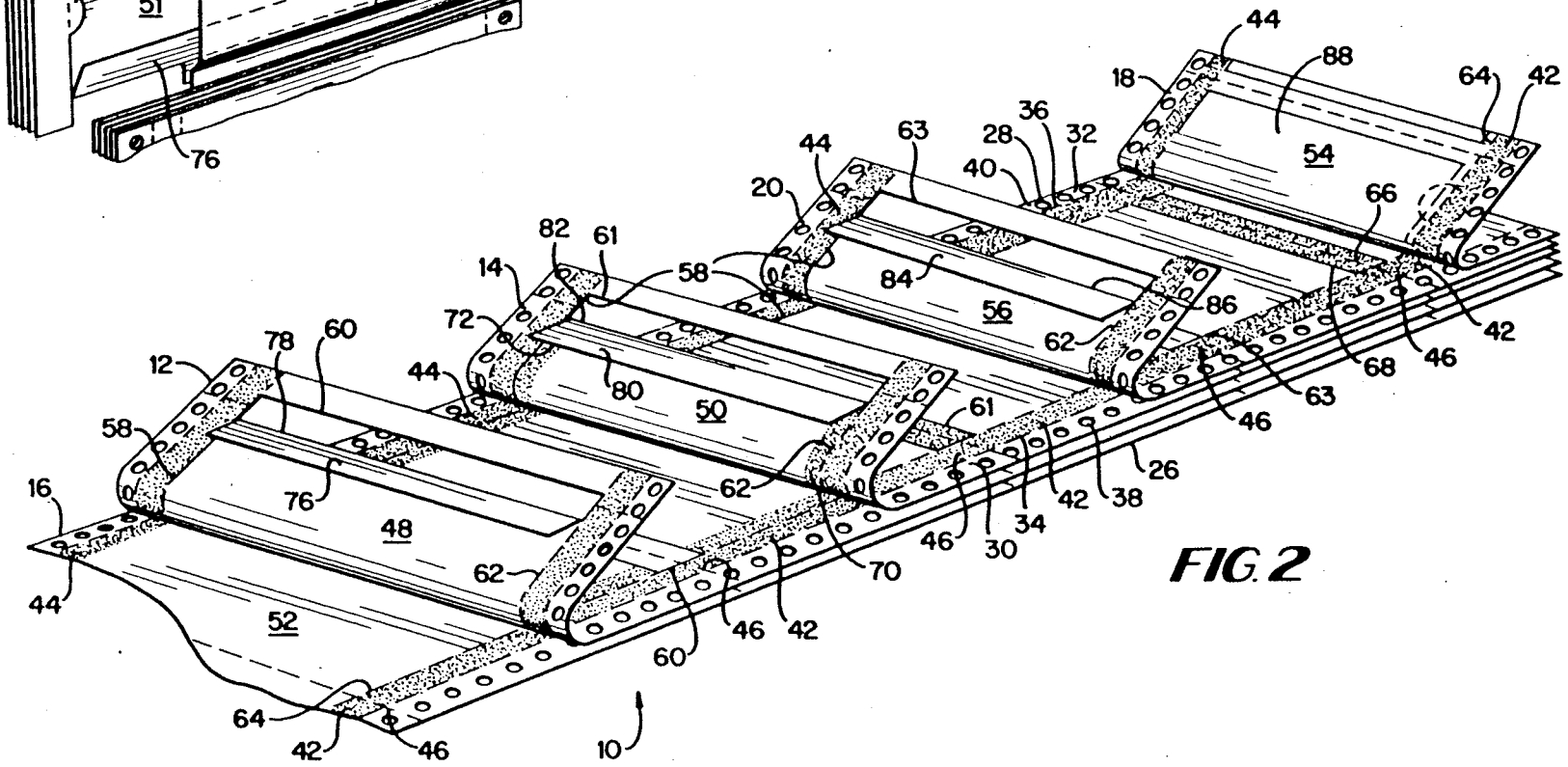
FIG. 2 is a perspective view of the embodiment shown in FIG. 1 with its webs progressively peeled back.
Figure 3:
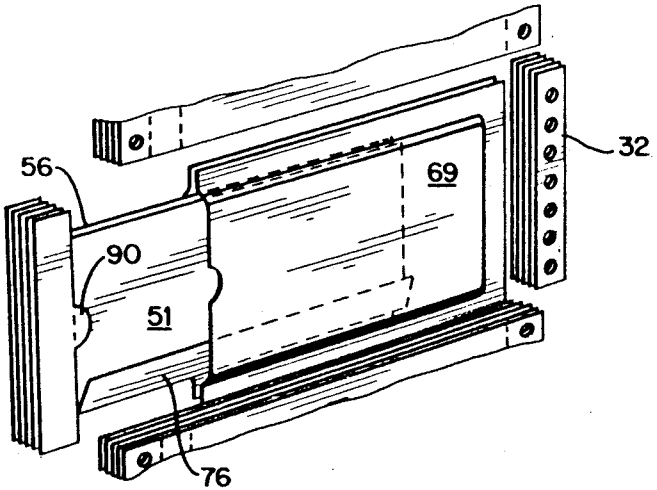
FIG. 3 is a perspective view of a single one of the series of message and envelope units formed by the preferred embodiment, as separated from its adjacent units and burst apart during use.

Referring to FIGS. 1-3, one exemplary embodiment of the invention is a continuous business form assembly 10. The assembly includes five webs, specifically a first web 12, a second web 14, a third web 16, a fourth web 18, and a fifth web 20. In order from the top of FIG. 1, the webs are 18, 20, 14, 12, 16.

Each web 12–20 has a longitudinal extent along its direction of continuity 22, and a transverse extent along a transverse direction 24 perpendicular to the direction 22. Along transversely marginal, longitudinally extending (i.e., marginal) edges 26, 28 of the assembly 10, each web 12–20 has marginal feed strips 30, 32, respectively, defined by marginal perforation lines 34, 36 and marginal rows of spaced feed holes 38, 40, respectively. Longitudinal first and second glue lines 44, 42, which are a type of means for joining the webs, extend along the inward sides of the marginal perforation lines 34, 36 and join the webs 12–20. Spaced, transverse lines of perforations 46 divide the webs 12–20 into sheets or panels 48, 50, 52, 54, 56, respectively.

Inward of the first glue line 44, the webs 12, 14, and 20 have perforation lines 58 interrupted by openings 60, 61 and 63, respectively. Inward of the second glue line 42, the webs 12, 14, and 20 have perforation lines 62, also interrupted by the openings 60, 61, 63 and the webs 16, 18 have continuous perforation lines 64.

The openings 60, 61, 63 are centered on the transverse perforation lines 46, and extend transversely from the perforation lines 58 to the perforation lines 62. Glue lines 66, 68 join the webs 16, 18 through the openings 60, 61, 63 along both sides of the transverse perforation lines 46. The glue lines 66, 68 combine with the glue lines 42, 44 to form originating envelopes 69 (FIG. 3) of the panels 52, 54, which contain the panels 48, 50, 56 of the webs 12, 14, 20, respectively.

Thus, the panels 48, 50, 56 are the contents of the originating envelopes 69. Panel 56 is a message sheet, which may be a bill, notice or the like. Panels 48, 50 form a return envelope 51, as will now be described.

Panels 48 have a longitudinal extent from one opening 60 to an adjacent opening 60; panels 50 have a longitudinal extent from one opening 61 to an adjacent opening 61; and panels 56 have a longitudinal extent from one opening 63 to an adjacent opening 63. The longitudinal extents of the panels 50, 56 are substantially identical to each other. Along the inner sides of the perforation lines 58, 62, and on the face toward panel 48, panel 50 has longitudinal glue lines 70, 72. Along one of its adjacent openings 61 and on the same face, the panel 50 further has a transverse glue line 74. The glue lines 70, 72, 74 join the panels 48, 50 along three of their sides, forming a pocket.

On its face away from the panel 50, and at its transverse edge opposite the glue line 74, the panel 48 has a flap 76. The flap 76 is folded back against the panel 48 along a fold line 78. The edge of the opening 60 in the web 12 adjacent the flap 76 is formed by the fold line 78, and the transverse and longitudinal extents of the flap 76 equal the transverse and longitudinal extents, respectively, of the opening 60.

Similarly, panel 50 on its face away from panel 56 and at its transverse edge adjacent opening 61, is provided with a second flap 80 which is folded back against the panel 50 along a fold line 82 which defines one edge of the opening 61. Fold line 82 may be formed as a transverse line of perforations, permitting the flap 80 to be removed from the panel 50.

Similarly, panel 56 on its face away from panel 54 and at its transverse edge adjacent opening 63, may, if desired, also be provided with a third flap 84 which is folded back against the panel 56 along a fold line 86 which defines one edge of the opening 63. Fold line 86 may also be formed by a transverse line of perforation which also permits flap 84 to be removed from the panel 56.

From the above description, it will become apparent that flaps 76, 80 and 84 have been die cut from the respective panels 48, 50 and 56 along three edges each to form the openings 60, 61 and 63.

The detachability feature of flaps 80 and 84 permits these flaps to be utilized as receipts, remittance vouchers and the like, thereby saving paper and eliminating the need for separate inserts.

These relationships exist between the flaps 76, 80 and 84 and openings 60, 61 and 63, respectively, because they are simultaneously formed, and the flaps 76, 80 and 84 are integral with the webs 12, 14 and 20, respectively. The two transverse and one longitudinal edges of each of the flaps 76, 80 and 84 and of the openings 60, 61 and 63 are formed by cutting, or slitting, of the webs 12, 14 and 20. The other longitudinal edges of the flaps 76, 80 and 84 and of the openings 60, 61 and 63 are defined by the fold lines 78, 82 and 86 as the flaps 76, 80 and 84 are folded back.

The panels 48, 50 form the return envelope 51, with an integral, top opening flap 76. Flap 80 is provided on the other of the return envelope webs, while flap 84 is provided on a message sheet. Both flaps 80 and 84 are detachable and serve as removable stubs in the form of receipts, return vouchers or the like, to be separated from the respective webs upon receipt by a first recipient of the mailer.

As now described, the assembly 10 provides continuous series of originating envelopes 69, message sheets 56 and return envelopes 51. For computer printing, a carbon backing 88 (or a carbonless, i.e., "self contained" coating) is provided on any one or all of the panels 48–54 (shown on panel 54 in FIG. 2, for example) and one or more of the flaps 80, 84. The units of the envelopes 51, 69 and sheets 56 may be printed, separated as in FIG. 3 from adjacent units and their feed strips 30, 32, and then sent.

Upon receipt, the envelopes 69 may be opened by transverse stress using thumb notches 90, again as in FIG. 3. The contents 51, 56 may then be pulled from the envelopes 69 and used. One or the other or both of flaps 80 and 84 are removed, and if the flap 76 has been prepared with an adhesive for the recipient, the return envelope 51 may be readily sealed and returned to the originator.

The invention, the preferred embodiment and the manner and process of making and using the invention have now been described in such full, clear, concise and exact terms as to enable any person skilled in the art to make and use the same. The best mode contemplated by the invention of carrying out the invention has been set forth.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A continuous business form assembly comprising at least a first web, a second web, a third web and a fourth web, all the webs being continuous in a longitudinal direction, and having a transverse extent perpendicular to the longitudinal direction, the first web also having first longitudinally spaced, transversely extending flaps, the flaps each having cut edges and a folded edge, the flaps being folded and thereby providing, first openings in the first web adjacent the flaps, the second web having second longitudinally spaced, transversely extending removable flaps, the flaps each having cut edges and a folded edge defined by a transverse line of perforations, the second flaps being folded and thereby providing second openings in the second webs adjacent the second flaps, said second openings longitudinally and transversely substantially aligned with said first openings of the first web, the second web being joined to the first web to form return envelopes such that said first flaps are return envelope flaps, and the second flaps comprise stubs adapted to be removed by a recipient of the form, and wherein the third web being joined to the fourth web, in part through the openings of the first and second webs, and the third and fourth webs being adapted to form originating envelopes including therein the return envelopes.

2. A continuous business form assembly as in claim 1 in which the longitudinal extent of the return envelope flaps substantially equals the longitudinal extent of the openings in the first web.

3. A continuous business form assembly as in claim 1 in which the transverse extent of the return envelope flaps substantially equals the transverse extent of the openings in the first web.

4. A continuous business form assembly as in claim 1 in which all the webs include transverse perforation lines adjacent the openings which divide all the webs into sheets.

5. A continuous business form assembly as in claim 1 in which the return envelope flaps are folded along the folded edges flat against the first web.

6. A continuous business form assembly as in claim 1 in which the first and second webs include return envelope panels with the folded edges of the return envelope flaps forming first edges of the return envelope panels of the first web, the return envelope panels of the first and second webs having other edges and each return envelope panel of the first web being joined to a return envelope panel of the second web along the other edges.

7. A continuous business form assembly as in claim 1 and further including a fifth web comprising a message sheet within said originating envelope.

8. A continuous business form assembly as in claim 7 wherein said fifth web is provided with third longitudinally spaced, transversely extending flaps each having cut edges and a folded edge, the third flaps being folded to thereby provide openings in the fifth webs adjacent said third flaps.

9. In a continuous business form assembly comprising a first web, a second web, a third web and a fourth web, all the webs being continuous in a longitudinal direction, and having a transverse extent perpendicular to the longitudinal direction the first web also having longitudinally spaced, transversely extending flaps, the flaps each having cut edges and a folded edge, the flaps being folded and thereby providing openings in the first web adjacent the flaps, the second web having openings longitudinally and transversely substantially aligned with the openings of the first web, the second web being joined to the first web to form return envelopes such that the flaps are return envelope flaps, and the third and fourth webs being adapted to form originating envelopes including therein the return envelopes, wherein the second web is also provided with longitudinally spaced transversely extending flaps having cut edges and a folded edge defining the openings in the second web.

10. A continuous business form assembly as in claim 9 and further including a fifth web comprising a message sheet within said originating envelope.

11. A continuous business form assembly as in claim 10 wherein said fifth web is provided with third longitudinally spaced, transversely extending flaps each having cut edges and a folded edge, the third flaps being folded to thereby provide openings in the fifth webs adjacent said third flaps.

12. A return mailer form construction comprising a first pair of sheets defining an originating envelope; and a second pair of webs defining a return envelope, each of said second pair of webs provided with a folded flap portion, one of said folded portions comprising a return envelope flap, the other of said folded flap portions comprising a removable message stub, said mailer further including at least one additional web comprising a message sheet having a folded flap portion.

13. The return mailer according to claim 12 wherein one of said message stub or said message sheet is a remittance voucher.

14. The return mailer according to claim 12 wherein said message stub is a receipt.

* * * * *